United States Patent [19]

Franchini et al.

[11] Patent Number: 4,498,439

[45] Date of Patent: Feb. 12, 1985

[54] CARBURETOR FITTED WITH ELECTROMAGNETIC DEVICES FOR INTERCEPTING THE FLOW OF FUEL DURING ACCELERATOR RELEASE

[75] Inventors: Mauro Franchini, Bologna; Angelo Sarasso, Turin; Angelo Puccetti, Lagaro, all of Italy

[73] Assignee: Weber S.P.A., Turin, Italy

[21] Appl. No.: 477,440

[22] Filed: Mar. 21, 1983

[30] Foreign Application Priority Data

Apr. 13, 1982 [IT] Italy ..... 3397 A/82

[51] Int. Cl.[3] ..... F02M 3/08

[52] U.S. Cl. ..... 123/438; 261/66

[58] Field of Search ..... 123/339, 344, 350, 325, 123/438; 261/66, 67, DIG. 19

[56] References Cited

U.S. PATENT DOCUMENTS

| | | | |
|---|---|---|---|
| 3,455,260 | 7/1969 | Mennesson | 123/339 |
| 3,996,909 | 12/1976 | Fischer | 261/DIG. 19 |
| 4,132,199 | 1/1979 | Kuroiwa et al. | 261/67 |
| 4,146,594 | 3/1979 | Raud | 261/DIG. 19 |
| 4,335,689 | 6/1982 | Abe et al. | 123/344 |

FOREIGN PATENT DOCUMENTS

| | | | |
|---|---|---|---|
| 56-50230 | 5/1981 | Japan | 123/339 |

*Primary Examiner*—William A. Cuchlinski, Jr.
*Attorney, Agent, or Firm*—Stevens, Davis, Miller & Mosher

[57] ABSTRACT

A carburetor is described, comprising a main barrel; a throttle; an idle system positioned between a cavity full of fuel and the main barrel, with progression and idle mixture holes, the opening of which is regulated by the conical point of an element to be positioned in a first position with respect to the said idle mixture hole by means of screws; the system comprises a hole for metering the fuel and a bush for metering the emulsion air; a first electromagnetic element has an obturator for closing the said hole with a ball; the element is connected to the movable keeper of a second electromagnetic device for moving the conical point away from the idle mixture hole; control devices are present to operate the said electromagnetic devices during accelerator release.

5 Claims, 4 Drawing Figures

CARBURETOR FITTED WITH ELECTROMAGNETIC DEVICES FOR INTERCEPTING THE FLOW OF FUEL DURING ACCELERATOR RELEASE

This invention is relative to carburetors for internal combustion engines and refers more particularly to the idle system, which comprises a fuel reserve pipe, a channel which connects the said pipe to the main barrel by means of the progression idle mixture holes and calibrated holes to meter the fuel and the air to form an emulsion which passes through part of the said system.

There are devices currently available for intercepting the flow of fuel during accelerator release in order to reduce consumption, limit the amount of pollutants emitted by the exhaust and increase the braking effect of the engine.

There are two basic types of the said devices. The first type of devices operate the throttle, bringing it into a position of very small opening so that the progression and idle mixture holes are upstream; the second type of devices are positioned in the idle system to close the hole which meters the fuel or the channel. Both types of device can be controlled by electronic, electromagnetic or pneumatic organs.

The known devices of the above-mentioned types have the defect of causing the idle system to empty during accelerator release; when the accelerator is depressed again, the engine is fed for a few seconds with a very lean mixture, since the said system delivers are alone; the consequent problems of vehicle driving disappear only when the correct carburation is re-established in the idle system too and this takes place when the said system is again full of fuel. In known types of carburetors normal carburation is delayed by the fact that a very low vacuum operates on the idle jet. This is due to the presence of the traditional idle mixture hole, in which the taper point of the idling mixture adjusting screw is inserted to create a heavy localised loss of load necessary during the normal functioning of the system to achieve the correct strength of mixture which feeds the engine, but which, in carburetors with idle mixture intercepting organs, causes a long transient state to re-establish the delivery of emulsion necessary for correct engine feeding.

The main aim of this invention is to create a carburetor in which the above-mentioned problems are eliminated thus permitting correct carburation from the moment when the accelerator is depressed again, as a result of having notably reduced the said loss of load in the right amount of time.

To achieve this aim, the invention cosists of a carburetor characterised as stated in the claims; other aims, characteristics and advantages of the invention will be better understood by referring to the enclosed diagrams which represent two non-restrictive construction examples, in which:

Figure 1:
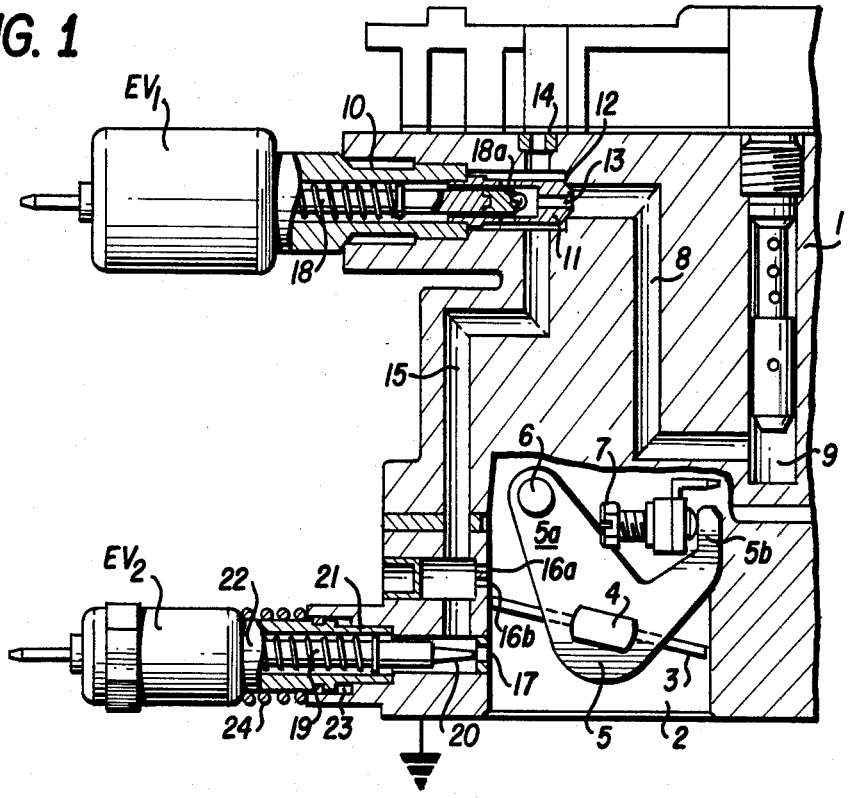
FIGS. 1 and 2 represent a partial cross-section of a first construction version of the invention in, respectively, a first and second functioning condition.
Figure 2:
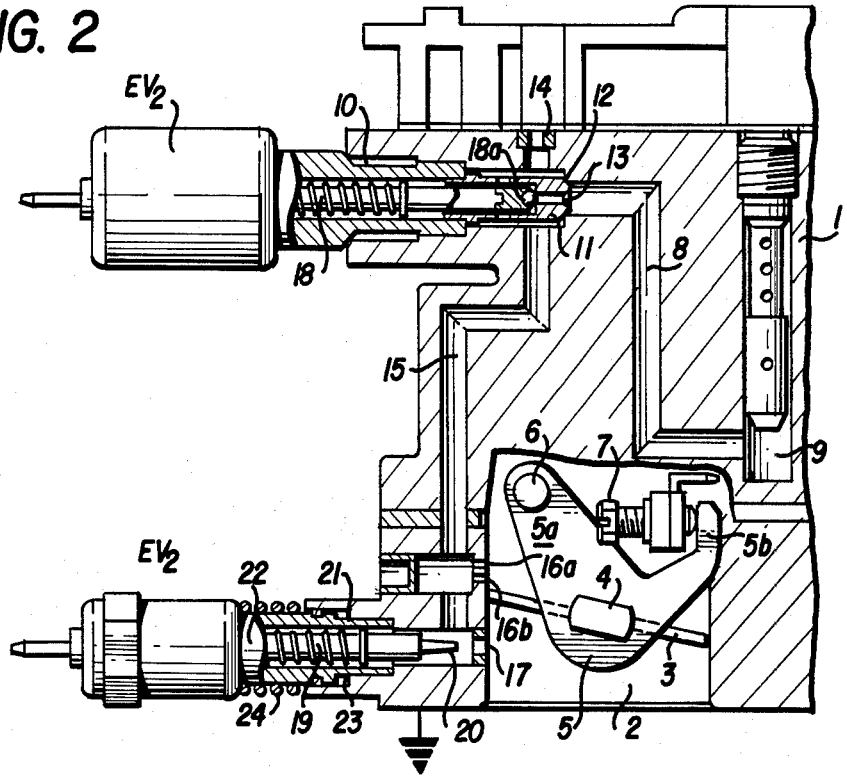

With reference to FIGS. 1 and 2, the entire carburetor is indicated with 1 and comprises a main barrel 2 which contains a throttle 3, rotating on a shaft 4 on which a control lever 5 is splined; an arm 5*a* of the lever 5 supports the accelerator coupling 6; an arm 5*b* of the same lever 5 abuts against a speed adjusting screw 7, which defines the position of the throttle 3 when the accelerator is released.

The idle system comprises a first channel 8 which begins at the base of the well 9 and terminates in a pipe 10 which houses an idling jet 11 that is positioned with a truncated conical part 12 at the mouth of the channel 8; the jet 11 has a hole 13 which meters the fuel passing through it; the idle system also comprises: a bush 14 which meters the emulsion air and a channel 15 which carries the emulsion to the progression holes 16*a* and 16*b* and to the idle mixture hole 17.

The jet 11, internally hollow, houses an obturator rod 18 integral with the movable keeper of a solenoid valve $EV_1$; the left hand end of the said rod 18 supports a ball 18*a* which closes the hole 13 under the action of the closing forces exercised by the solenoid valve $EV_1$. The cross-section of the idle mixture 17 is regulated by a conical point 20 of a rod 19 integral with the movable keeper of a second solenoid valve $EV_2$, the wrapping 21 of which has a threaded part 22 which is inserted in a housing 23 in the carburetor 1 near the hole 17; with the assistance of a spring 24, this makes it possible to position the point 20 with respect to the hole 17, in a stable way, so as to regulate the flow of emulsion to a minimum when the solenoid valve $EV_2$ is de-energised.

The solenoid valve $EV_2$ moves the rod 19 to extract the point 20 from the hole 17.

The bracket which supports the screw 7 is electrically connected to an electronic control unit, not shown, to inform it as regards the position of the main lever 5 and thus of the throttle 3; an electric closing signal is sent to the control unit when the arm 5*b* is in contact with the screw 7.

We shall now describe the functions of the electronic control unit to give a better understanding of the invention. The power unit controls the solenoid valves $EV_1$ and $EV_2$; if the engine speed exceeds a first threshold $R.P.M._1$ memorised in the said control unit, then this sends a signal to the solenoid valve $EV_1$ to keep the obturator rod 18 towards the left, so that the ball 18*a* keeps the section of passage 13 free; at the same time, it sends a control signal to the solenoid valve $EV_2$ to keep the point 20 of the rod 19 inserted in the hole 17, as can be seen in FIG. 1. When the accelerator is released, the control unit receives the said electric closing signal; since the engine speed is greater than $R.P.M._1$ the power unit controls the solenoid valve $EV_1$ to move the rod 18 to close the hole 13 with the ball 18*a*; at the same time, it controls the solenoid valve $EV_2$ to move the rod 19 towards the left in order to withdraw the point 20 from the hole 17; this condition is shown in FIG. 2. In this way, the value of the vacuum existing in the barrel 2 upstream from the throttle 3 settles on the jet 11; if the driver opens the throttle 3 slightly, the distance between the arm 5*b* and the screw 7 warns the control unit that the accelerator is no longer released; this controls the solenoid valve $EV_1$ to open the hole 13, but maintains the solenoid valve $EV_2$ as in FIG. 2 to keep the vacuum signal quite high at the height of the hole 13 and to obtain an instantaneous filling of the channel 15 of the idle system. The same functions are carried out by the control unit when the engine speed has fallen below a second threshold $R.P.M._2 < R.P.M._1$ to obtain a correct engine speed. Below a pre-determined engine speed value, the control unit resets the solenoid valves $EV_1$ and $EV_2$ as shown in FIG. 1.

Figure 3:
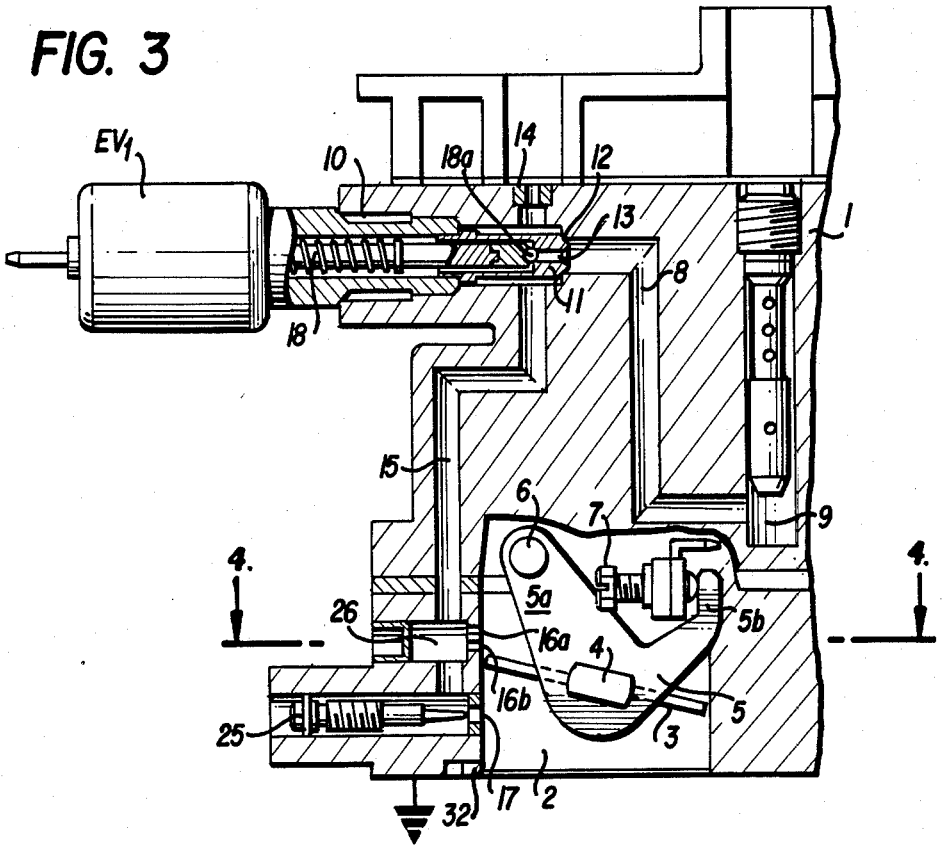
FIG. 3 represents a partial cross-section of a second construction version of the example.
Figure 4:
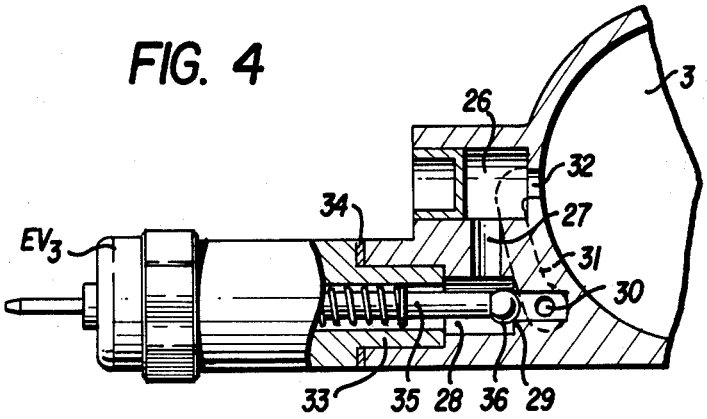
FIG. 4 represents a partial cross-section, along the line N—N, of the carburetor as in FIG. 3.

The carburetor shown in FIGS. 3 and 4 differs from that illustrated in FIGS. 1 and 2 as follows:

the idle mixture adjusting screw is the traditional type; the progression chamber 26 is connected to a cavity 28 by means of a channel 27; the cavity 28 leads to the cavity 30 through a passage 29; another channel 31 leads from the said cavity 30 and opens into the main barrel 2 by means of an opening positioned below the hole 17. An obturator rod is integral with the movable keeper of a solenoid valve $EV_3$, the wrapping 33 of which is supported by means of screws in the cavity 28; sealing elements 34 are present to prevent the entry of air into the cavity 28.

The obturator comprises a rod 35 and a ball 36, integral with the rod 35 to close the mouth 29 under pressure of the closing forces of the solenoid valve $EV_3$; in every other regard, the carburetor shown in these figures comprises the same construction elements as that shown in FIGS. 1 and 2.

We claim:

1. Carburetor for internal combustion engines, fitted with electromagnetic devices for intercepting the flow of fuel during accelerator release, comprising at least: a main barrel; a throttle positioned in said main barrel and which turns with a shaft; a main lever splined on said shaft and connected to to the accelerator to position said throttle; a speed adjusting screw to define the position of said throttle when accelerator is released; an electrical contact between said speed adjusting screw and said main lever to inform an electronic control unit of the position of said throttle and in particular of the definite position of said speed adjusting screw; an idle system which starts from a cavity full of fuel and which opens into said main barrel by means of progression and idle mixture holes and which comprises a first hole for metering the emulsion air; said carburetor being fitted with a first solenoid valve which is controlled by said power unit to close said first hole; said carburetor being characterised by the fact of having an obturator rod for assisting with an opening positioned in said idle system; said obturator being part of a second solenoid valve for moving it from a first position in which said obturator totally or partially closes said opening to a second position in which said obturator totally opens said opening to increase vacuum signal on said first hole and vice-versa; said control unit serving to send control signals to said second solenoid valve to maintain said obturator in said second position for a definite period of time subsequent to accelerator release.

2. Carburetor as in claim 1 characterised by the fact that said obturator comprises a rod, the conical point of which is for inserting in the idle mixture hole to define the outflow section of said hole; said rod being integral with the movable keeper of said second solenoid valve, the wrapping of which has a threaded part for inserting into a first cavity facing said idle mixture hole to define the position of said point with respect to said hole when said second solenoid valve is not energised; a spring assisting said wrapping to maintain said point in said position.

3. Carburetor as in claim 1 characterised by the fact that said obturator is positioned in a second cavity connected to the progression hole chamber by means of a first channel; said second cavity communicating by means of an opening with a third cavity, from which a second channel begins and opens into said main barrel by means of an opening; said obturator being part of the movable keeper of a third solenoid valve and serving to close said communication opening under the action of the forces exercised by said third solenoid valve.

4. Carburetor as in claim 3, characterised by the fact that said opening of said second channel is positioned vertically below said idle mixture hole.

5. Carburetor as in claim 1, 2 or 3, characterised by the fact that two thresholds of angular speed $RPM_1$ and $RPM_2$ are memorised in the control unit; above the first threshold $RPM_1$, the control unit enables said first solenoid valve to position, with the throttle closed, an obturator to close said first hole and to enable said second solenoid valve or said third solenoid valve to move said obturator, relative to said second or said third solenoid valve, into said second position; a determined time being memorised in said control unit to move said obturator of said second or said third solenoid valve from the second to the third position, after accelerator release is terminated.

* * * * *